US005899817A

United States Patent [19]

Dunikoski

[11] Patent Number: 5,899,817

[45] Date of Patent: May 4, 1999

[54] POLAR IMPACT GOLF CLUB APPARATUS

[76] Inventor: Richard T. Dunikoski, 2246 E. Myrtle Ave., Phoenix, Ariz. 85020

[21] Appl. No.: 08/900,849

[22] Filed: Jul. 25, 1997

[51] Int. Cl.[6] ..... A63B 53/04

[52] U.S. Cl. ..... 473/314; 473/341; 473/350

[58] Field of Search ..... 473/340, 341, 473/313, 350, 342, 345, 314, 344

[56] References Cited

U.S. PATENT DOCUMENTS

| | | | |
|---|---|---|---|
| 1,349,805 | 8/1920 | Booth | 473/342 |
| 1,509,429 | 9/1924 | Hillerich | 473/342 |
| 3,387,845 | 6/1968 | Raub | 473/340 |
| 3,578,332 | 5/1971 | Caldwell | 473/249 |
| 3,652,093 | 3/1972 | Reuter | 473/340 |
| 4,199,144 | 4/1980 | Skelly | 473/251 |
| 4,265,451 | 5/1981 | Bernhardt | 473/313 |
| 5,332,214 | 7/1994 | Tucker, Sr. . | |
| 5,333,863 | 8/1994 | Shenoha | 473/314 |
| 5,346,219 | 9/1994 | Pehoski et al. . | |
| 5,407,196 | 4/1995 | Busnardo | 473/246 |
| 5,460,375 | 10/1995 | Hardee | 473/300 |
| 5,464,218 | 11/1995 | Schmidt et al. . | |
| 5,509,660 | 4/1996 | Elmer | 473/288 |
| 5,531,445 | 7/1996 | Levocz et al. . | |
| 5,533,728 | 7/1996 | Pehoski et al. . | |
| 5,569,098 | 10/1996 | Klein | 473/300 |
| 5,749,791 | 5/1998 | Passeri . | |

*Primary Examiner*—Steven Wong
*Assistant Examiner*—Stephen L. Blau
*Attorney, Agent, or Firm*—H. Gordon Shields

[57] ABSTRACT

A golf putter head includes two portions, a front striking plate portion and a rear plate portion to which the shaft is secured. The front plate is secured to the back plate only at the opposite ends or poles of the two portions of the putter head. For a one piece head, machining of the head provides the polar configuration.

12 Claims, 1 Drawing Sheet

POLAR IMPACT GOLF CLUB APPARATUS

BACKGROUND OF THE INVENTION

1. Field of the Invention

This invention relates to golf club apparatus and, more particularly to golf club apparatus in which the shaft is secured to a back plate, and the back plate is secured to a front plate at only two locations, namely the opposite ends or poles of the front at plate.

2. Description of the Prior Art

U.S. Pat. No. 5,332,214 (Tucker Sr.) discloses a golf putter head which includes an elastomeric sticking face. The golf putter head includes several different pieces. The elastomeric front face is softer than the hardness of a golf ball. Weights may be added in various combinations.

U.S. Pat. No. 5,464,218 (Schmidt et al) discloses another golf putter head in which there is a recess behind the front face. The recess provides a front plate of a is reduced thickness. Several recesses are defined within the head.

U.S. Pat. No. 5,346,219 (Pehoski et al) discloses a symmetrical golf putter head, and recesses are found in the head. The striking face flexes to cradle and guide the ball.

U.S. Pat. No. 5,531,445 (Levocz et al) discloses a golf putter head in which the shaft is adjustable and recesses are found within the head.

U.S. Pat. No. 5,533,738 (Pehoski et al) discloses another golf putter head in which there are recesses and the striking surface is flexible, similar to the above disclosed '219 patent.

SUMMARY OF THE INVENTION

The invention described and claimed herein comprises a golf club, illustrated as a putter, having a head which includes a relatively rigid front plate which contacts the golf ball. The head includes a back plate, to which the shaft is secured, and which is secured to the front plate at opposite ends or poles of the club head. The force of putting is transferred to the back plate only at the outer ends or poles. Accordingly, a putter face striking a ball attains momentum or impact by polar impact.

Among the objects of the present invention are the following:

To provide new and useful golf club apparatus;

To provide new and useful golf putter apparatus;

To provide new and useful golf putter having a head which includes a back plate to which the shaft is secured and a front plate secured to the back plate;

To provide new and useful golf putter apparatus having a front plate secured to a back plate only at opposite ends of the plates; and To provide new and useful golf club apparatus having a relatively rigid front plate which strikes a golf ball.

DESCRIPTION OF THE PREFERRED EMBODIMENT

Figure 1:
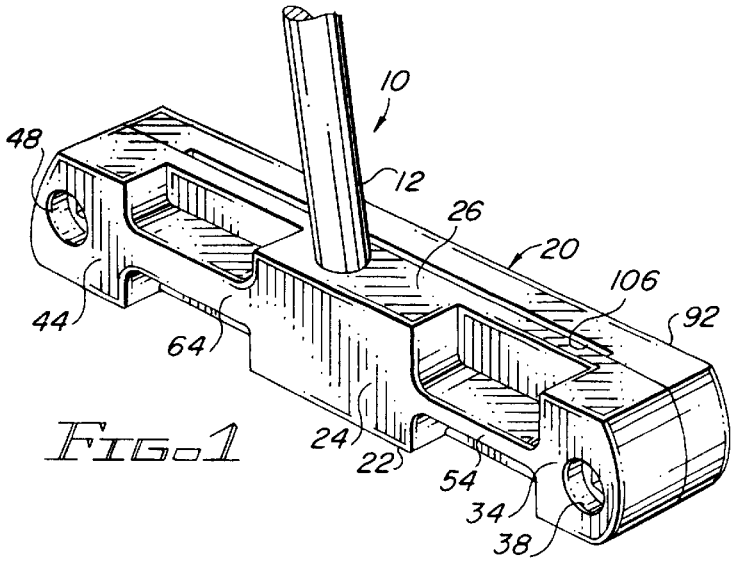
FIG. 1 is a perspective view of a golf putter head of the present invention.
Figure 3:
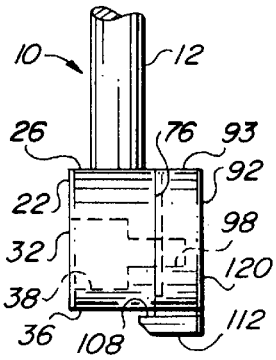
FIG. 3 is an end view of the apparatus of FIG. 1.
Figure 2:
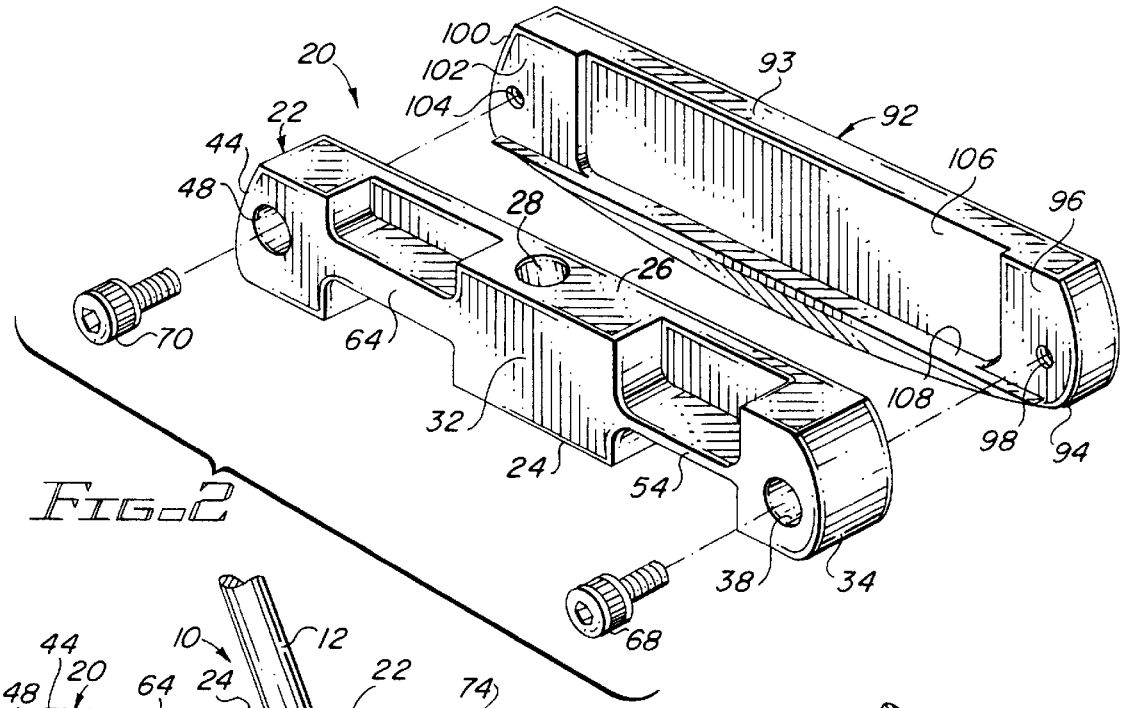
FIG. 2 is an exploded perspective view of the apparatus of the present invention.
Figure 5:
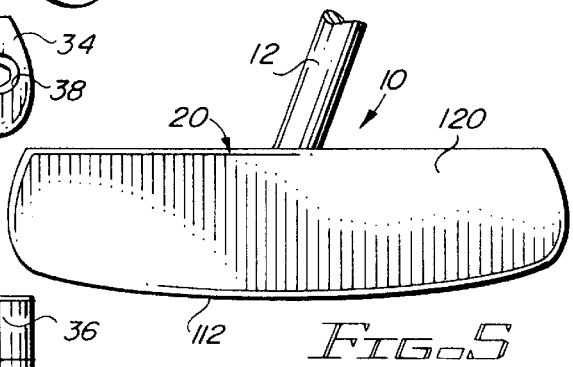
FIG. 5 is a front elevational view of the apparatus of the present invention.
Figure 6:
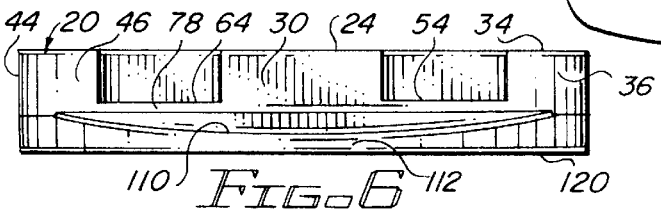
FIG. 6 is a bottom view of the apparatus of the present invention.

FIG. 1 is a perspective view of the lower portion of a golf club 10. The lower portion of a shaft 12 is shown connected to a putter head 20. FIG. 2 is an exploded perspective view of the putter head 20. FIG. 3 is an end view of the putter head 20 assembled and connected to the shaft 12. FIG. 3 is thus an end view of the apparatus of FIG. 1. Figure four is a rear elevational view of the putter head 20 and FIG. 5 is a front elevational view of the putter head 20. FIG. 6 is a bottom view of the putter head 20. For the following discussion, reference will generally be made to all of the Figures of the drawing.

The head 20 is divided into two elements, a back plate 22 and a front plate 92. The back plate 22 includes three primary or weighted portions, including a central portion 24, a forward end portion or toe end portion 34, and a rear end portion or heel end portion 44. The central portion 24 includes a top surface 26 into which extends a bore 28. The shaft 12 extends into and is appropriately secured in the bore 28.

The central portion 24 also includes a bottom surface 30 and a rear surface 32. The toe end portion 34 includes a bottom surface 36 which is aligned with the bottom surface 30 of the central portion 24. A web 54 extends between the toe end portion 34 and the central portion 24.

Figure 4:
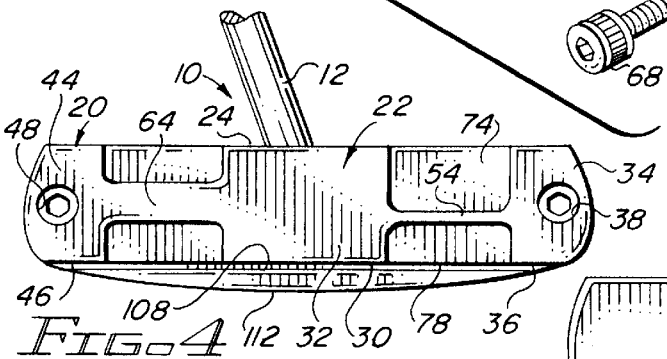
FIG. 4 is rear elevational view of the apparatus of the present invention.

The heel end portion 44 is spaced apart from the central portion 24 and is connected thereto by a web 64. It will be noted, as shown in FIGS. 1, 2, and 4, that the thicknesses of the webs 54 and 64 are different. The web 64 is considerably thicker than the web 54, and accordingly the web 64 includes more mass than does the web 54.

The heel end portion 44 includes a bottom surface 46 which is aligned with the bottom surface 30 of the central portion 24 and the bottom surface 36 of the forward end portion 34.

As best shown in FIGS. 1, 2, and 4, the back surface 32 of the central portion 24 is aligned with the back surface of the heel end portion 34 and the back surface of the heel end portion 44. That is, the rear surfaces of the central portion 24, the heel end portion 34, the heel end portion 44, and the webs 34 and 64 are coplanar and essentially define a single back surface made up of discrete portions.

Extending inwardly through the toe end portion 34 is a bore 38. The bore 38 extends through the front portion 34 and includes a rear counter bore portion. The heel end portion 44 similarly includes a bore and counterbore 48. The purpose of the bores and counter bores 38 and 48 is to receive fastener elements 68 and 70 to secure the front plate 92 to the back plate 22. The bore and counterbore 38 is shown in dotted line or in phantom in FIG. 3.

The front of the back plate 22 includes a longitudinally extending portion 74 which comprises a front part of the back plate 22 and essentially connects together the three portions, the central portion 24, the toe end portion 34, and the heel end portion 44. The longitudinal portion 74 is coextensive with the top surface 26 of the central portion 24. The top surface of the toe end portion 34 and the heel end portion 44 are also coplanar with the surfaces 26 and 74. The longitudinal portion 74 includes a bottom surface 78 which is also coplanar with the bottom surfaces 30, 36, and 46, of the central portion 24, the toe end portion 34, and the heel end portion 44.

The longitudinal portion 74 also has a front face 76 which is generally parallel to the back surface 32. As may best be understood from FIGS. 3 and 4, the front face 76 of the longitudinal portion 74 is generally parallel to the back surface 32, and the top surface 26 is generally parallel to the bottom surface 78. The bottom surface 78 is coplanar with the bottom surfaces 30, 36, and 46 of the three portions 24, 32, and 44, respectively, of the back plate 22.

The front plate 92 includes a front end or toe end pole 94 and a rear end or heel end pole 100. The toe end pole 94 includes a rear face 96, and a tapped aperture 98 extends into the rear face 96. The tapped aperture 98 is aligned with the bore and counter bore 38 of the forward portion 34 of the back plate 22. The tapped aperture 98 accordingly receives the threaded portion of the fastener 68.

The rear end or pole 100 includes a rear face 102 which is aligned with the rear face 96 of the toe end or pole 94. A tapped aperture 104 extends into the rear face 102. The tapped aperture 104 is appropriately aligned with the bore and counter bore 48 for receiving the threaded portion of the fastener 70.

Between the rear faces 96 and 102 is a relieved portion 106. The relieved portion 106 extends downwardly from a top surface 93 of the front plate 92 and terminates in a bottom shoulder 108. The bottom shoulder 108 extends rearwardly from or beyond the rear faces 96 and 102. The overall depth or height of the relieved portion 106 is greater than the overall height of the back plate 22. This may be best understood from FIGS. 3 and 4.

Beneath the bottom shoulder 108, and extending between the toe end or pole 94 and the heel end pole 100, is a curved bottom 112.

Extending downwardly and inwardly between the bottom shoulder 108 and the curved bottom 112 is a concave portion 110. The concave portion 110 is best shown in FIG. 6.

The bottom shoulder 108 extends slightly beneath or underneath a portion of the back plate 22 and is disposed below it. This is best shown in FIG. 3. Thus, when the front plate 92 is secured to the back plate 22, the only contact between the two plates is at the rear faces 96 and 102 of the poles 94 and 100. This assures that the weight of the head 20 is essentially concentrated only at the two poles 94 and 100.

In prior art golf putters, there is a spot on the club head referred to as the "sweet spot." This is the location on the head at which the user tries to contact the ball. Typically the "sweet spot" is a relatively small area on the centerline of the head. In the apparatus of the present invention, the sweet spot is an impact zone. While the "sweet spot" of the prior art is typically a relatively small area, the impact zone of the present invention is a relatively large area, extending about an inch or so on each side of the vertical center line of the face 120. The center line is defined as the alignment of the shaft 12 with the head 20.

Prior art putters are essentially levers, and if a ball doesn't contact the "sweet spot," there may be deflection, or pivoting, of the putter face away from the desired path of the ball. That is, there may be a deflection away from the desired direction.

With the apparatus 10, if a ball is struck in the relatively large impact zone, there will be no deflection of the putter. This lack of deflecting and the enlarged impact zone is due to the polar structure of the head.

For a putter head 20 of about 4.5 inches (11.5 cm.) in overall length, the impact zone will extend about one inch (2.54 cm.) in both directions away from the center line along the face 120 of the head 20. The impact zone is thus about two inches (5 cm.) in length, or almost half the overall length of the putter head 20.

When a golf ball is contacted in the impact zone by the front face 120 of the front plate 92, there will be no adverse effect on a wrist, or no twisting action that causes fatigue on the wrists.

The impact of the front face 120 contacting a golf ball may be referred to as a polar impact since the force of a putt as a front face contacts a ball provides that the weighted portion of the head is provided only at opposite ends of the front fact.

In turn, this provides that the golf ball will move straight off the golf club face.

Due to the construction of the head 20, the head is relatively rigid and there is essentially no flexing of the head when the ball is contacted. The lack of flexing helps to insure that the golf ball travels in a straight line in the desired direction, namely straight off the face 120.

The construction of the head 20 also insures that a roll or overspin is put on the ball, causing the ball to stay on the ground. Thus, with overspin, there is a better chance of the ball dropping into a cup or hole. The ball essentially hugs the ground, and accordingly does not travel as far as prior art putters with the same stroke force.

Again, due to the construction of the head 20, the putter provides a degree of control not otherwise available with contemporary golf putter heads.

While the drawing illustrates a two piece putter head appropriately secured together, as by threaded fasteners, it is obvious that the putter could be made of a one piece casting and appropriately machined to provide essentially the same configuration. However, with contemporary construction techniques, it appears less expensive to manufacture the putter head from two separate pieces and appropriately secure the two pieces together.

It is obvious that the putter head could be made of any appropriate material, such as stainless steel, brass, or even ceramic material.

While the golf club 10 has been illustrated as a putter, it is obvious that the same construction techniques are applicable to other clubs, such as drivers and wedges. A major structural concept with the apparatus is that of providing a polar impact when the head contacts a golf ball. Another major concept is that the head is relatively rigid and does not flex as the ball is contacted. These concepts are obviously applicable to drivers and wedges, as well as to putters.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted to specific environments and operative requirements without departing from those principles. The appended claims are intended to cover and embrace any and all such modifications, within the limits only of the true spirit and scope of the invention.

What I claim is:

1. Polar impact golf club apparatus comprising in combination:

a handle;

back plate means secured to the handle, including a toe end portion having substantial mass, a heel end portion having substantial mass and located remote from the toe end portion, and a bottom surface; and front plate means secured to the back plate means at the toe end portion and at the heel end portion, including a front face for contacting a golf ball and a bottom shoulder disposed below and spaced apart from the bottom surface of the back plate means.

2. The apparatus of claim 1 in which the front plate means further includes a toe end pole and a heel end pole, and the front plate means is secured to the back plate means at the toe and heel end poles.

3. The apparatus of claim 2 in which the front plate means further includes a relieved portion extending between the toe and heel end poles.

4. The apparatus of claim 1 in which the back plate means further includes a front face extending from the toe end portion to the heel end portion.

5. The apparatus of claim 4 in which the back plate means further includes a central portion disposed between the toe end portion and the heel end portion, and the handle is secured to the central portion.

6. The apparatus of claim 5 in which the back plate means further includes a first web extending between the toe end portion and the central portion, and a second web extending between the central portion and the heel end portion.

7. Polar impact golf club apparatus comprising in combination:

a handle;

back plate means secured to the handle, including a central portion to which the handle is secured, a toe portion spaced apart from the central portion, a heel portion spaced apart from the central portion and remote from the toe portion, a front surface extending from the toe portion to the heel portion, and a bottom surface; and front plate means secured to the back plate means at the forward end portion and the rear portion, including a front face for contacting a golf ball and a bottom shoulder disposed below and spaced apart from the bottom surface of the back plate means.

8. The apparatus of claim 7 in which the back plate means further includes a first web extending between the central portion and the toe portion, and a second web extending between the central portion and the heel portion.

9. The apparatus of claim 6 in which the front plate means further includes a toe end pole connected to the back plate means at the toe portion, and a heel end pole connected to the back plate means at the heel portion.

10. The apparatus of claim 9 in which the front plate means further includes a relieved portion extending between the toe and heel end poles.

11. The apparatus of claim 10 in which the bottom shoulder extends between the toe and heel end poles and is disposed beneath a portion of the back plate means.

12. The apparatus of claim 7 in which the front plate means is relatively rigid so that it does not deflect as the front face contacts a golf ball.

* * * * *